US008393485B2

(12) United States Patent
Gold et al.

(10) Patent No.: US 8,393,485 B2
(45) Date of Patent: Mar. 12, 2013

(54) FOOD CONTAINER FOR USE IN FREEZER STORAGE OF A FOOD PORTION

(75) Inventors: Jonathan Morris Gold, London (GB); Daniel Jason Tyler, Molles (FR)

(73) Assignee: Brother Max Limited, Borehamwood (GB)

( * ) Notice: Subject to any disclaimer, the term of this patent is extended or adjusted under 35 U.S.C. 154(b) by 849 days.

(21) Appl. No.: 12/376,784

(22) PCT Filed: Aug. 14, 2007

(86) PCT No.: PCT/GB2007/003092

§ 371 (c)(1),
(2), (4) Date: Feb. 9, 2009

(87) PCT Pub. No.: WO2008/020193

PCT Pub. Date: Feb. 21, 2008

(65) Prior Publication Data

US 2010/0170897 A1 Jul. 8, 2010

(30) Foreign Application Priority Data

Aug. 18, 2006 (GB) ..... 0616441.2
May 22, 2007 (GB) ..... 0709775.1

(51) Int. Cl.
*B65D 21/028* (2006.01)

(52) U.S. Cl. ..... 220/23.4; 220/23.6; 220/601; 220/625; 206/504; 206/508; 206/509; 249/127

(58) Field of Classification Search ..... 206/499, 206/503, 504, 508, 509; 220/23.2, 23.4, 220/23.6, 23.8, 23.83, 23.86, 212, 601, 611, 220/614, 624, 625, 630, 632, 633, 636, 638; 249/217

See application file for complete search history.

(56) References Cited

U.S. PATENT DOCUMENTS

| | | | | | |
|---|---|---|---|---|---|
| 1,495,837 | A | * | 5/1924 | Garske | 220/625 |
| 2,053,711 | A | * | 9/1936 | Glomb | 249/120 |
| 2,182,454 | A | * | 12/1939 | Sherman | 62/345 |
| 2,631,747 | A | * | 3/1953 | Stolte | 215/10 |
| 2,960,248 | A | * | 11/1960 | Kuhlman | 215/10 |
| 2,982,440 | A | * | 5/1961 | Harrison | 220/609 |
| 3,077,284 | A | * | 2/1963 | McLaughlin | 220/780 |
| 3,194,426 | A | * | 7/1965 | Brown, Jr. | 220/23.4 |
| 3,323,668 | A | | 6/1967 | Hills | |
| 3,374,917 | A | * | 3/1968 | Troy | 220/23.4 |

(Continued)

FOREIGN PATENT DOCUMENTS

| | | |
|---|---|---|
| DE | 29800782 U | 3/1998 |
| DE | 10123206 A1 | 2/2002 |

(Continued)

OTHER PUBLICATIONS

12376784—DesignBoom_WaterBlock_967 (2004).*

(Continued)

*Primary Examiner* — J. Gregory Pickett
*Assistant Examiner* — Ned A Walker

(57) ABSTRACT

There is provided a food container for use in freeze storage of a food portion. The food container comprises a body defining a compartment for receipt of the food portion; a sealing lid for reversible sealing of the compartment; and provided to the body, one or more connectors, each connector arranged for reversible mating connection to a mating connector provided to a second body of a second similar food container.

7 Claims, 9 Drawing Sheets

U.S. PATENT DOCUMENTS 3,483,908 A * 12/1969 Donovan ..... 221/260
3,640,018 A * 2/1972 Light ..... 446/77
3,944,074 A * 3/1976 Riley ..... 206/427
4,043,477 A * 8/1977 Deese ..... 220/23.4
4,057,946 A * 11/1977 Barrett ..... 52/436
4,133,455 A 1/1979 Moser
4,624,383 A * 11/1986 Moore ..... 220/23.4
4,656,840 A * 4/1987 Loofbourrow et al. ..... 62/530
4,886,239 A 12/1989 Stimmel
4,889,254 A 12/1989 Vola
4,899,976 A * 2/1990 Cederroth et al. ..... 249/61
4,919,296 A 4/1990 Kirsh et al.
4,981,214 A 1/1991 Rojas
4,982,858 A * 1/1991 von Holdt ..... 220/23.4
5,000,713 A * 3/1991 Cheng ..... 446/120
5,002,199 A * 3/1991 Frahm ..... 220/670
D322,938 S * 1/1992 Baroi ..... D9/564
D333,978 S * 3/1993 Zutler ..... D9/743
5,249,684 A * 10/1993 Sterett ..... 206/503
D346,627 S * 5/1994 Bach ..... D21/501
5,310,071 A * 5/1994 Rivlin et al. ..... 220/23.4
5,312,011 A * 5/1994 Fischer ..... 220/528
5,361,906 A * 11/1994 Sterett ..... 206/509
5,381,916 A * 1/1995 Strawder ..... 220/23.4
5,392,945 A * 2/1995 Syrek ..... 220/608
D356,255 S * 3/1995 Syrek ..... D9/424
5,397,542 A * 3/1995 Nelms et al. ..... 422/562
5,469,979 A * 11/1995 Chiou ..... 215/228
D369,100 S * 4/1996 Johnson ..... D9/640
5,507,389 A * 4/1996 Syrek ..... 206/508
D371,281 S * 7/1996 Credle, Jr. ..... D7/625
D377,887 S * 2/1997 Credle, Jr. ..... D7/625
5,676,251 A * 10/1997 Credle, Jr. ..... 206/501
5,699,925 A * 12/1997 Petruzzi ..... 220/4.27
5,709,304 A 1/1998 Credle, Jr.
5,782,358 A * 7/1998 Walker ..... 206/509
5,876,776 A * 3/1999 Credle, Jr. ..... 426/394
5,890,595 A * 4/1999 Credle, Jr. ..... 206/501
5,896,993 A * 4/1999 Nask et al. ..... 206/508
D421,335 S * 3/2000 Linard ..... D3/314
6,276,549 B1 8/2001 Fasci et al.
D447,944 S * 9/2001 Justice ..... D9/745
6,360,884 B1 * 3/2002 Smith et al. ..... 206/209.1
6,371,321 B1 * 4/2002 Lee ..... 220/23.4
D464,887 S * 10/2002 Sherwell ..... D9/516
6,588,612 B1 * 7/2003 Dorn et al. ..... 215/10
6,793,193 B2 * 9/2004 de Groote ..... 249/119
7,014,162 B2 * 3/2006 Lion et al. ..... 249/121
D531,514 S * 11/2006 Harris ..... D9/560
7,175,498 B2 * 2/2007 Garpow et al. ..... 446/117
7,520,399 B2 * 4/2009 Lane et al. ..... 215/10
2005/0151049 A1 * 7/2005 Lion et al. ..... 249/121
2005/0151050 A1 * 7/2005 Godfrey ..... 249/127
2006/0261063 A1 * 11/2006 Dyehouse ..... 220/23.4
2008/0000867 A1 * 1/2008 Lane et al. ..... 215/10
2010/0072095 A1 * 3/2010 Salovaara ..... 206/427

FOREIGN PATENT DOCUMENTS

DE 10135206 A1 * 2/2002
DE 10324119 A1 12/2004
EP 1236651 A1 9/2002
FR 2847131 A1 5/2004

OTHER PUBLICATIONS

12376784—DesignBoom_Cube_1874 (2004).*

* cited by examiner

FOOD CONTAINER FOR USE IN FREEZER STORAGE OF A FOOD PORTION

TECHNICAL FIELD

The present invention relates to a food container that is suitable for containing foodstuffs for an infant and in particular, one that is suitable for frozen storage thereof.

BACKGROUND TO THE INVENTION

When weaning a young infant onto solid foods, it is common practice to feed that young infant with puréed foods. Such puréed foods can be purchased ready made in jars or cartons, but this is often an expensive option. Many carers therefore prefer to prepare their own puréed foods at home. Such preparation typically involves preparation of a suitable foodstuff in bulk, which is then puréed and separated out into separate food portions (e.g. sized to provide a single meal serving for the infant). It is convenient for the carer to store such separate food portions in the freezer, and the carer therefore has an ongoing need to identify a suitable storage container to use for this purpose.

Ice cube trays having plural separate cavities are well-known in the prior art, and these are often used by the carer for such purpose. Standard ice cube trays are however, not ideal because they typically have no lid and the foodstuff is therefore potentially open to contamination, and also because it is notoriously difficult to remove individual cubes from the tray. Such difficulty can be compounded for the carer who needs ready access to individual cubes of the frozen foodstuff to enable ready preparation of a meal for a hungry and often crying infant.

An alternative approach would be for the carer to simply store each individual portion in a separate lidded food container. The disadvantage of this approach is that the home freezer rapidly becomes cluttered with many separate food containers. Finding the right food container at the infant's mealtime can therefore become a frustrating task.

The present invention provides advantages over each of the above approaches by providing a lidded food container that is arranged to receive a food portion, wherein the body of that container is provided with one or more connectors, and each connector is arranged for ready reversible connection to a mating connector provided to the body of a second similar (e.g. identical) food container. Thus, in a typical use scenario plural such food containers would separately be filled with a food portion. The separate containers would then be connected up to form an assembly of food containers, each separately-lidded and each containing a separate portion of food. This assembly would then be placed in the freezer for convenient, uncluttered frozen storage thereof. At mealtime, the carer would then remove the assembly from the freezer and disconnect a single food container from the assembly for use at that mealtime. The assembly is then placed back in the freezer.

In a development of the present invention, each food container is arranged to be amenable to microwave cooking. Thus, in a further step in the above typical use scenario the carer would place the separated off food container in the microwave for microwave warming up of the individual food portion contained therein. This again is advantageous over the use of standard ice cube trays in that when such trays are employed the removed frozen cube of puréed food must be transferred to another container (e.g. plate or bowl) for microwave warming thereof.

It is an object of the present invention to provide a food container that is suitable for use in frozen storage of infant foodstuffs.

It is a supplementary object of the present invention to provide a food container that is suitable for use in microwave warming up of frozen infant foodstuffs.

SUMMARY OF THE INVENTION

According to a first aspect of the present invention there is provided a food container for use in containing a food portion for freezer storage thereof comprising a body defining a compartment for receipt of said food portion;

a sealing lid for reversible sealing of said compartment; and provided to said body, one or more connectors, each said connector arranged for reversible mating connection to a mating connector provided to the body of a second similar food container.

There is provided a food container that is arranged to be suitable for use in containing a food portion for freezer storage thereof. In embodiments, the food container is also suitable for containing that food portion for microwave warming thereof.

The food container herein is particularly suitable for use in the containment of puréed foodstuffs for feeding to infants and is thus, in embodiments formed of a liquid impermeable material. In embodiments, that material can both withstand (i.e. retain its structural integrity in) temperatures typically encountered in a domestic freezer and a domestic microwave (e.g. from −20° C. to 150° C.).

The food container comprises a body defining a compartment for receipt of the food portion, wherein the compartment is in embodiments sized and shaped for its intended purpose.

In embodiments, the body comprises a base and one or more walls, wherein the edge(s) of said wall(s) define a rim. The rim defines the mouth of (i.e. entrance to) the compartment.

In one aspect, the body is pot-shaped and thus, comprises an essentially circular base, a single circumferential wall and an essentially circular rim.

In one aspect, the body is generally box-shaped (e.g. cuboid) and thus, comprises a square or rectangular base, four square or rectangular side walls and a square or circular rim. Embodiments are envisaged in which, certain of the edges of an essentially box-shaped body are rounded off for ease of user comfort.

In embodiments, the base of the body is arranged to be flexible such that a user may push up on the base (e.g. using the thumb) to force the frozen contents thereof from the compartment. In one aspect, the base is provided as a flexible insert (e.g. formed of rubber or another similar flexible material). The insert is in aspects, moulded to the body.

In embodiments, a well-shaped profile is defined by the base of the body and the flexible insert is provided as the base of that well-shaped profile. In alternative embodiments, the insert itself defines a well-shaped profile (e.g. of circular cross-sectional profile) provided to the base of the body. In embodiments, that well is bounded by a periphery (e.g. circumferential), which forms either part of the insert or part of the base of the body. In embodiments, the periphery and/or side wall(s) of the well is arranged for receipt of a protrusion such as a protruding wall (e.g. circular) provided to the top side of the lid of the sealing lid to enable stacking of the containers.

The food container is provided with a sealing lid for reversible sealing of the compartment, wherein the seal is arranged to be a good enough seal for the intended purpose. Preferably, the seal is generally liquid tight.

In embodiments, the lid engages with the rim of the body such as by means of a mating rim provided to the lid (e.g. at the underside of the lid). Any suitable types of engagement are envisaged, particularly press-fit or snap-fit types of engagement between the rim of the body and the lid (e.g. mating rim thereof). The lid may in aspects, be separate from the body or provided integrally therewith or be mounted thereto.

In embodiments, the lid mounts to the body by way of a hinge mounting. The hinge mounting is suitably arranged such that in use, when the lid is disengages from the rim of the body the lid remains hingedly attached.

In embodiments, the hinge mounting locates at the top edge of a first side wall of the body, and the lid is hingedly movable from a first position in which the (mating rim of the) sealing lid locates adjacent to the rim of the body (e.g. as when the lid is in a sealing configuration) to a second position, in which the lid locates alongside the side wall. Thus, a 'disengage and flip open lid' style of operation may be envisaged, which is convenient for the user particularly since the lid remains mounted to the container body, thereby eliminating any 'lost or misplaced lid' scenarios.

In embodiments, the lid is provided with a first securing portion and the first side wall of the body (i.e. that side wall whose top edge has the hinge mounting located thereat) is provided with a second securing portion such that when hinged down to the second position alongside the first side wall the lid may be secured onto that first side wall (i.e. secured into the second position). This securing down of the lid is also convenient for the user in that lid is secured down away from the mouth of the container body and thus, away from any food filling/removal operations being conducted at the compartment mouth.

The securing ('docking') of the lid to the side wall of the container is reversible and preferably the first and second securing portions are sized/shaped to enable ready and convenient securing/unsecuring by the user.

The first securing portion of the lid and second securing portion of the first side wall may take any suitable securing ('docking') forms. In embodiments, securing is by press or snap fit type arrangement. In embodiments, the first securing portion of the lid comprises a protrusion extending from the top of the lid and the second securing portion of the first side wall comprises a flange or cavity arranged for secured (e.g. docked) receipt of that first securing portion. In embodiments, the protrusion has the form of a curved wall (e.g. part-circumferential) and the flange or cavity defines a corresponding curved wall profile (e.g. crater-like cavity) to enable secured receipt thereof.

In embodiments, the first securing portion of the lid (e.g. a protrusion extending from the top of the lid) is further arranged for receipt by a periphery of a well-shaped insert provided to the base of the body of the container. Thus, the first securing portion has dual-function: 1. to enable securing of the lid to the first side wall in the 'hinged fully open' second position of the lid; and 2. to enable stacking of the container to the base of the body of another similar food container.

The body of the food container is provided with one or more connectors. Each connector is arranged for ready reversible connection to a mating connector provided to the body of a second similar (e.g. of identical type) food container.

Thus, each one or more connector is arranged for readily reversible mating connection with a second connector provided to the body of a second similar food container.

In one aspect, the connector has a male projection arranged for mating receipt by the female projection of the second connector. In another aspect, the connector has a female form arranged for mating receipt by the male projection of a second connector. In embodiments, the mating engagement is of the press-fit or snap-fit type.

The one or more connectors are generally provided to one or more walls of the body (e.g. one connector per wall). However, other embodiments are envisaged in which the one or more connectors are (also) provided to the base and/or sealing lid. Thus, for example, a base to sealing lid type mating connection is envisaged.

In embodiments, where the container is box-shaped, two of the four walls thereof are provided with male connectors and two with female connectors. In one aspect, the male and female connectors locate on opposite walls (i.e. at 180° displacement) relative to each other. In one aspect, the male and female connectors locate on neighbouring walls (i.e. at 90° displacement) relative to each other. These two specific types of arrangement have been found to readily accommodate modular assembly forms as described in more detail hereinafter.

In embodiments, a dual-half moon connector arrangement is envisaged. In this arrangement, the connector comprises a first projecting half-circumferential wall ('a first half moon'); and a second projecting half-circumferential wall ('a second half moon'), wherein the first and second projecting half-circumferential walls extend radially about the same centre, but are radially displaced 180° relative to each other, and wherein the maximum radial extent of the first projecting half-circumferential wall is equal to or just less than the minimum radial extent of the second projecting half-circumferential wall.

In respect of the food container herein, a connector is provided to at least one side wall of the container, which thus effectively acts as a 'connector base'.

Applicant has also realized that the half-moon connector arrangement may be employed more generally than in respect of the food containers herein, for use in joining two bodies (each provided with a connector of this type) thereto.

In more detail, each connector of the dual-half moon connector arrangement comprises a first projecting half-circumferential (i.e. 180° radial extent) wall; and a second projecting half-circumferential (i.e. 180° radial extent) wall.

In embodiments, each of the first and second half-circumferential walls may define a half-circular profile. In alternative embodiments, that half-circular profile is compressed or expanded such that a compressed or expanded ovular profile is defined.

In embodiments, the first projecting half-circumferential wall has a first wall thickness and the second projecting half-circumferential wall has a second wall thickness. In embodiments, the first wall thickness is equal to the second wall thickness.

The first and second projecting half-circumferential walls extend radially about the same central point, but are radially displaced 180° relative to each other.

The maximum radial extent of the first projecting half-circumferential wall is equal to or preferably just less than (e.g. about 0.1 to 2 mm less than) the minimum radial extent of the second projecting half-circumferential wall.

The height of the first and second projecting half-circumferential walls approximately corresponds. In embodiments, that height is constant. In other embodiments, the wall height varies from one end of the wall to the other, wherein the variation of height of the first wall mirrors that of the corresponding second wall.

On mating it will be appreciated that a first dual half-moon connector is mated with a second half-moon connector, and that in the mating configuration the first projecting half-circumferential wall of the first half-moon connector seats alongside/against the second projecting half-circumferential wall of the second half moon connector, and similarly the second projecting half-circumferential wall of the first half-moon connector seats alongside/against the first projecting half-circumferential wall of the second half moon connector.

According to another aspect of the present invention there is provided a modular assembly of plural food containers herein, wherein each food container of the assembly matingly connects to at least one other food container thereof.

It will be appreciated that the modular assembly herein provides the advantage that the food containers may be connected (e.g. snapped) together to best fit the available space in a home freezer of the user.

A preferred modular assembly herein comprises plural box-shaped food containers, wherein each of the four walls thereof is provided with a connector. Thus, highly space-efficient modular assemblies may be provided for.

In embodiments, the food container herein is comprised of a plastic polymer material and/or a rubber material. Suitable plastic polymer materials include polyvinyl chloride and polypropylene. In one aspect, the plastic polymer material is an injection-moulded plastic polymer material.

It will be appreciated that the elements of the food container herein may be manufactured and supplied separately and/or supplied as a pre-assembly or a kit of parts. In particular, plural food containers herein may be sold as a kit for use in constructing a modular assembly herein. The present invention encompasses all of these separate component parts and any assemblies thereof.

BRIEF DESCRIPTION OF THE DRAWINGS

The invention will now be described further with reference to the accompanying drawings, in which:

Referring now to the drawings, FIGS. 1*a* to 1*c* illustrate different views of a first food container 1 herein suitable for use in containing a food portion for freezer storage thereof.

Figure 1A:
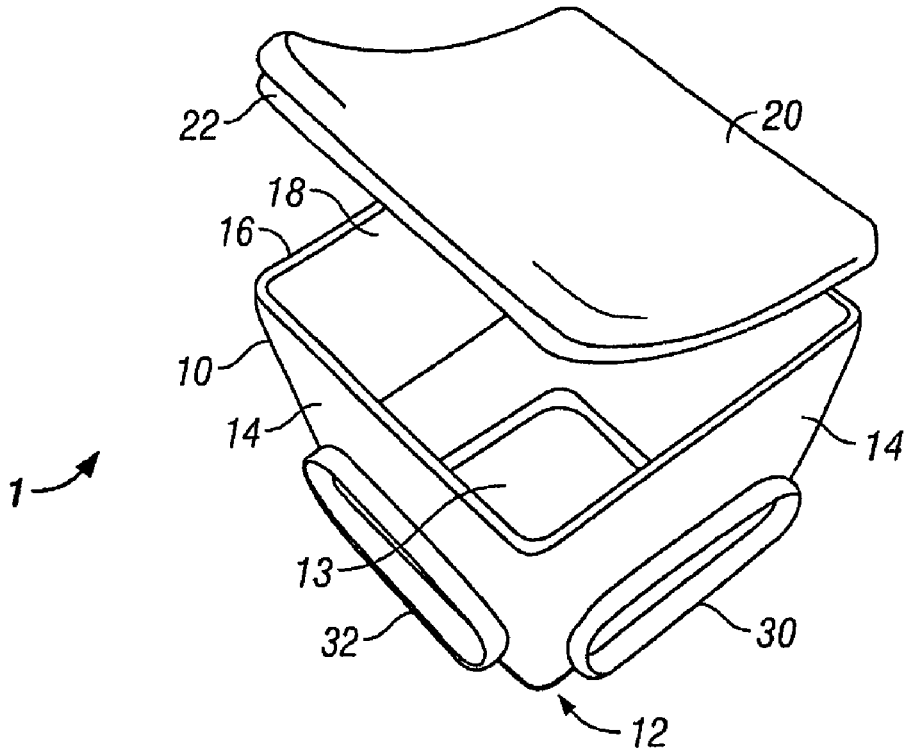
FIGS. 1*a* to 1*c* shows a perspective views from respectively above, below and from one side of a first food container in accord with the present invention.

In more detail, the food container 1 comprises a body 10 having a base 12 and four side walls 14 defining a rim 16, which defines the mouth of a food-receiving compartment 18 within the body 10. It will be appreciated that the form of the body 10 is generally that of a cuboid box, but that certain of the edges have been rounded off for user comfort reasons. The body 10 is formed of an injection-moulded plastic polymer material (e.g. polyvinyl chloride or polypropylene) that is freezer and microwave safe. The base 12 of the body 10 is provided with a moulded flexible insert 13. In use, the user may push up (e.g. using their thumb) on the flexible insert 13 to eject any frozen contents of the compartment 18 from the body 10.

The food container 1 has a sealing lid 20 that has a lid rim 22 arranged for snap-fit sealing engagement with the rim 16 of the body 10. Each side wall 14 of the body 10 is provided with a connector arranged for reversible mating connection to a mating connector provided to the body of a second similar food container. In more detail, as shown in FIG. 1, each food container 1 has two male connectors 30 and two female connectors 32, wherein the male 30 and female 32 connectors locate on opposite walls 14 (i.e. at 180° displacement) relative to each other.

Figure 1B:
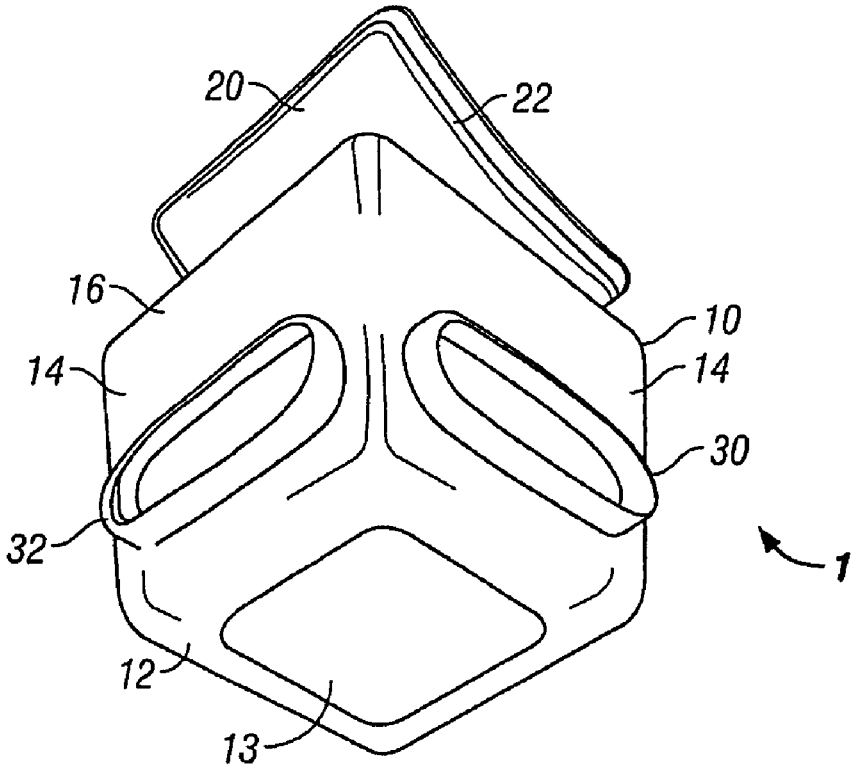
Figure 1C:
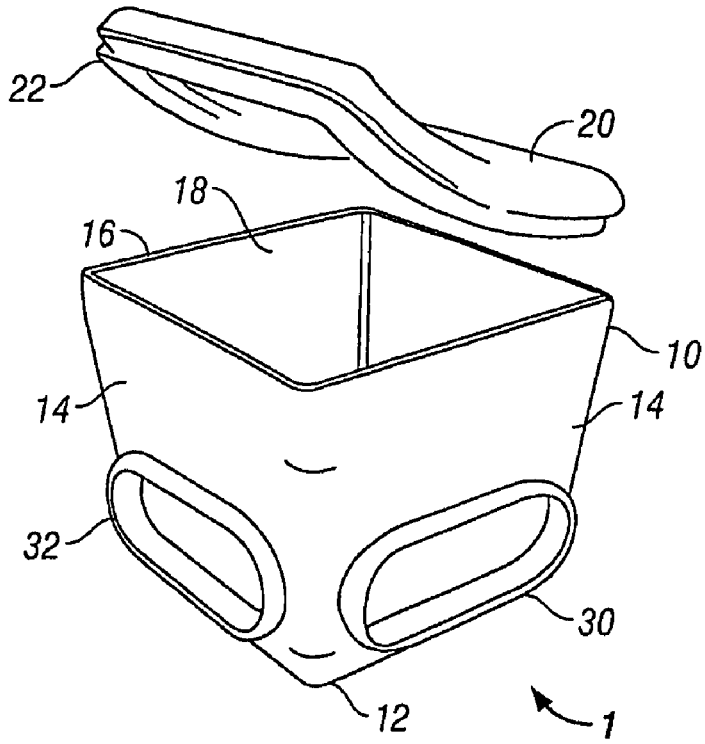
Figure 5:
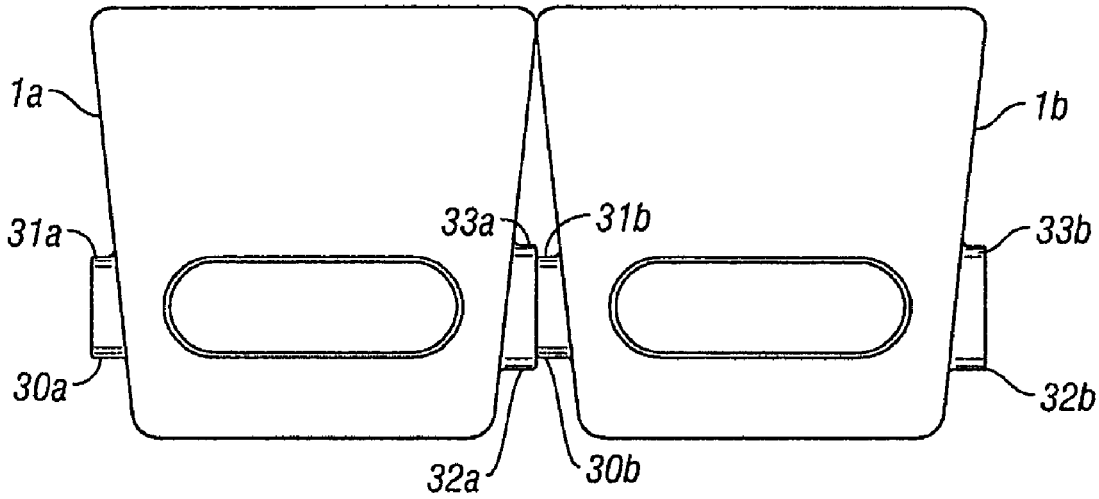
FIG. 5 shows a side view of the first modular assembly of FIG. 2 showing a detail of the mating connection between the two of the first food containers thereof.

Details of the mode of connection may be obtained by reference to FIG. 5, in which first and second containers 1*a*, 1*b* of the type shown in FIGS. 1*a* to 1*c* are shown in mating engagement. The male projection 31*b* of the male connector 30*b* of the second container 1*b* is received within the female form rim 33*a* of the female connector 32*a* of the first container 1*a*. Oppositely-located to the mating connection, the first container 1*a* also has a male connector 30*a* with male projection 31*a*, and the second container 1*b* also has a female connector 32*b* with female form rim 33*b*.

It is an advantage of the food containers of the present invention that various modular assemblies thereof may be constructed using mating connections between individual food containers. Referring now to FIGS. 2 to 5 various forms of assembly are illustrated.

Figure 2:
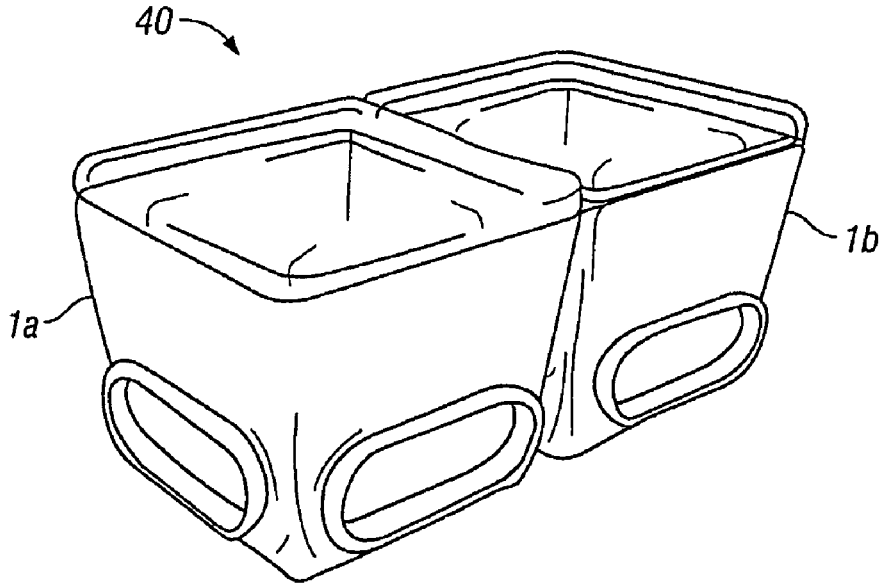
FIG. 2 shows a perspective view of a first modular assembly of two of the first food containers of FIGS. 1*a* to 1*c;*
Figure 3:
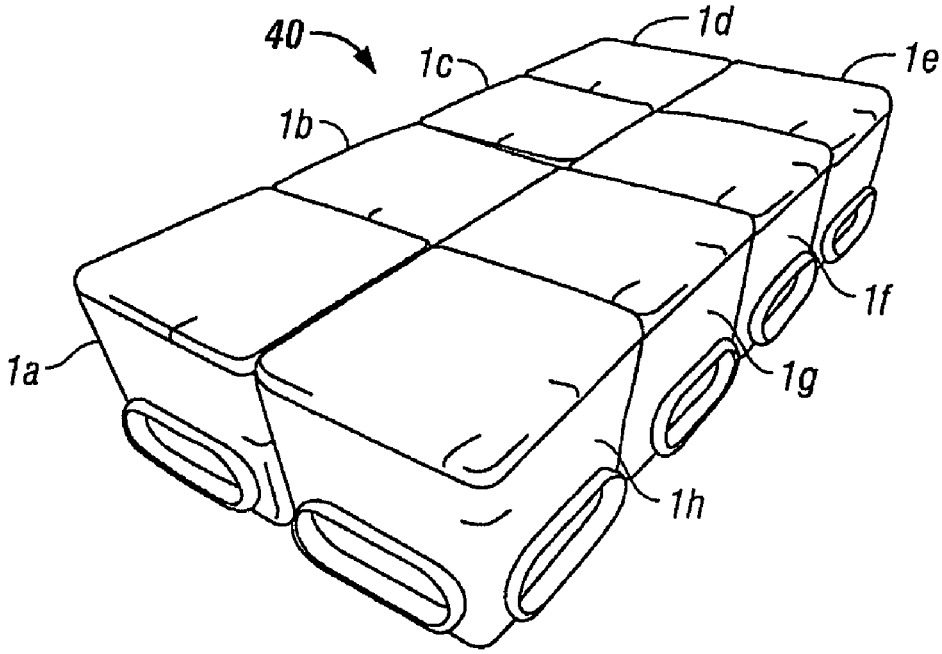
FIG. 3 shows a perspective view of a second modular assembly of eight of the first food containers of FIGS. 1*a* to 1*c;*
Figure 4:
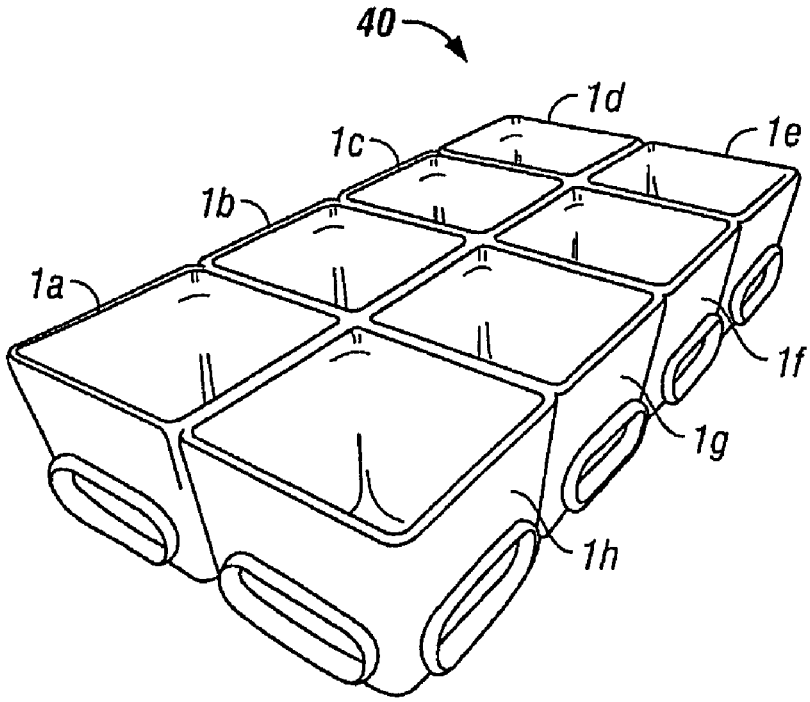
FIG. 4 shows a perspective view of the second modular assembly of FIG. 3 with all sealing lids removed.

Thus, in FIGS. 2 and 5 a pair-wise assembly 40 of two food containers 1*a*, 1*b* is shown. In FIGS. 3 and 4 a rectangular form assembly 40 of eight food containers 1*a* to 1*h* is shown. It will be appreciated that other shapes of assembly may be constructed.

Figure 6A:
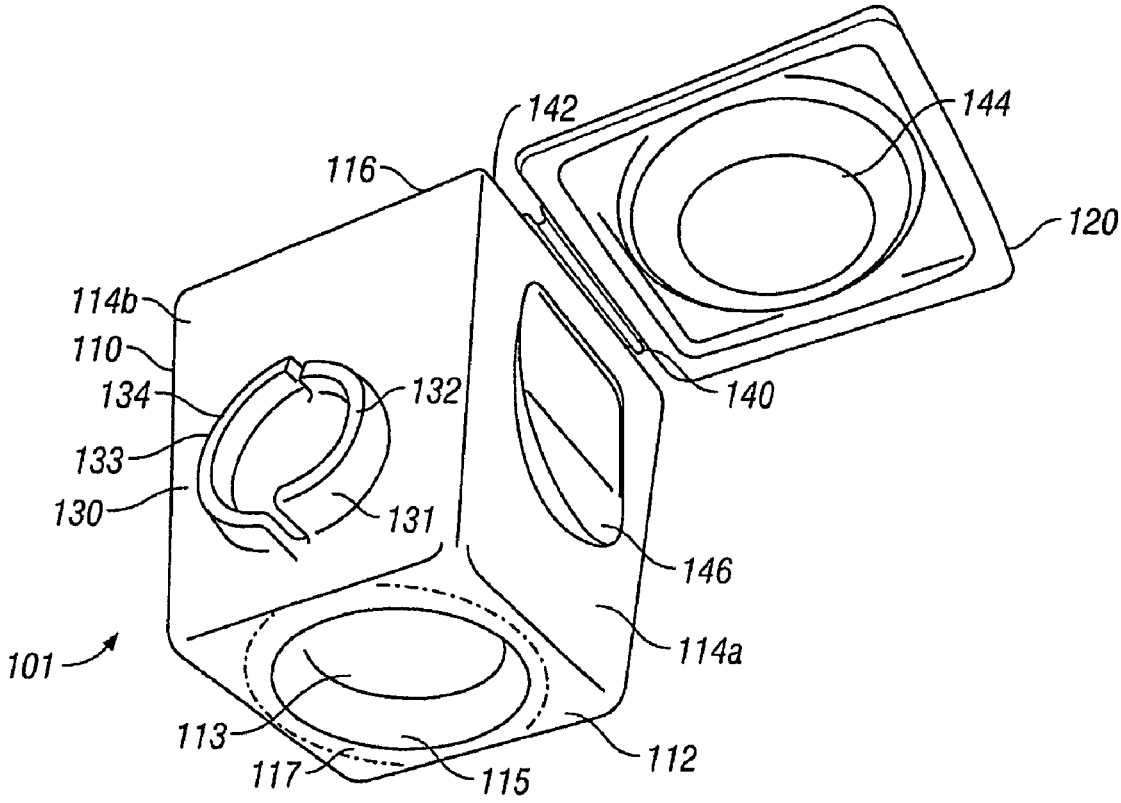
FIGS. 6*a* and 6*b* respectively show a perspective view from below and a view from one side of a second food container in accord with the present invention.
Figure 6B:
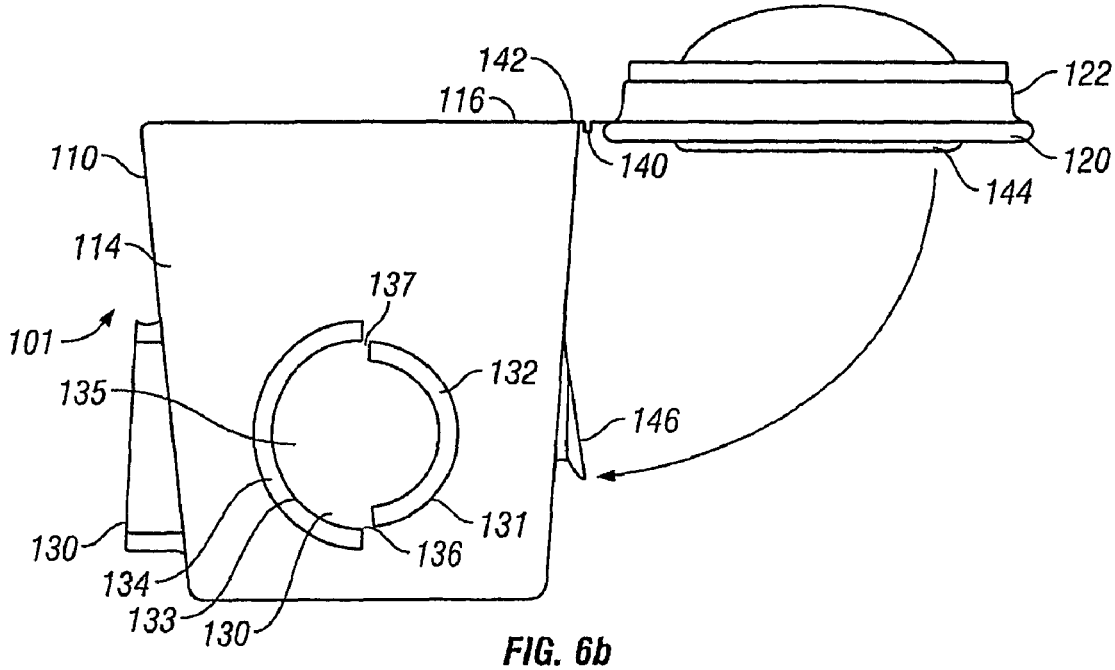

FIGS. 6*a* and 6*b* illustrate different views of a second food container 101 herein suitable for use in containing a food portion for freezer storage thereof.

In more detail, the food container 101 comprises a body 110 having a base 112 and four side walls 114*a*, 114*b* (two only labelled) defining a rim 116, which defines the mouth of a food-receiving compartment 118 within the body 110. It will be appreciated that the form of the body 110 is generally that of a cuboid box, but that certain of the edges have been rounded off for user comfort reasons. The body 110 is formed of an injection-moulded plastic polymer material (e.g. polyvinyl chloride or polypropylene) that is freezer and microwave safe. The base 112 of the body 110 is provided with a moulded flexible insert 113, which sits within a well having well walls 115 and bounded by a periphery 117. In use, the user may push up (e.g. using their thumb) on the flexible insert 113 to eject any frozen contents of the compartment 118 from the body 110.

The food container 101 has a sealing lid 120 that has a lid rim 122 arranged for snap-fit sealing engagement with the rim 116 of the body 110. The sealing lid 120 mounts to the body 110 by way of a hinge mounting 140 that locates at the top edge 142 of a first side wall 114*a* of the body 110.

The sealing lid 120 is hingedly movable from a first position in which the sealing lid 120 locates adjacent to the rim 116 of the body 110 to a second position, in which the sealing lid 116 locates alongside the first side wall 114*a*. FIGS. 6*a* and 6*b* show the sealing lid at a position intermediate between the first and second positions, wherein the arrow indicates the direction of travel therebetween.

It will also be seen that the sealing lid 120 is provided with a first securing portion comprising a protruding circular wall 144 that extends from the top side 121 of the sealing lid 120. The first side wall 114*a* of the body 110 is provided with a second securing portion comprising a semi-circular profile flange 146. It will be appreciated that when the sealing lid is in the second ('hinged fully down' or 'flipped fully open') position the sealing lid 120 may be reversibly secured onto the first side wall 114*a* by securing of the first securing portion 144 to the second securing portion 146.

The first securing portion 144 provided to the sealing lid 120 is further sized and shaped for receipt by periphery 117 of the tapering well-shaped insert 115 provided to the base 112 of the container 101. Thus, the first securing portion 144 has dual-function: (a) to enable securing of the sealing lid 120 to the first side wall in the 'hinged fully down' second position of the lid 120; and (b) to enable stacking of the container 101 to the well-shaped insert 115, 117 of the base 112 of another similar food container. A stacking arrangement is described later by reference to FIG. 9.

Each side wall 114*a*, 114*b* of the body 110 is provided with a connector arranged for reversible mating connection to a mating connector provided to the body of a second similar food container. In more detail, and also with reference now to FIGS. 7 and 8, each food container 101 comprises half-moon type connector 130.

Each half moon connector comprises a first projecting half-circumferential wall 132 and a second projecting half-circumferential wall 134, each of which extends about common central point 135 (see FIG. 6*b*). It will be appreciated that the first 132 and second 134 projecting half-circumferential walls are radially displaced 180° relative to each other. The radial profile of the outer edge 131 of the first projecting half-circumferential wall 132, which defines the maximum radial extent thereof, is just less than (e.g. 0.1 to 2 mm less than) the radial profile of the inner edge 133 of the second projecting half-circumferential wall 134, which defines the minimum radial extent thereof. Gaps 136, 137 between the top and bottom of the 'half moons' 132, 234 will be noted. The wall thicknesses of the first and second projecting half-circumferential walls 132, 134 are the same, and their wall heights are constant and equal.

Figure 7:
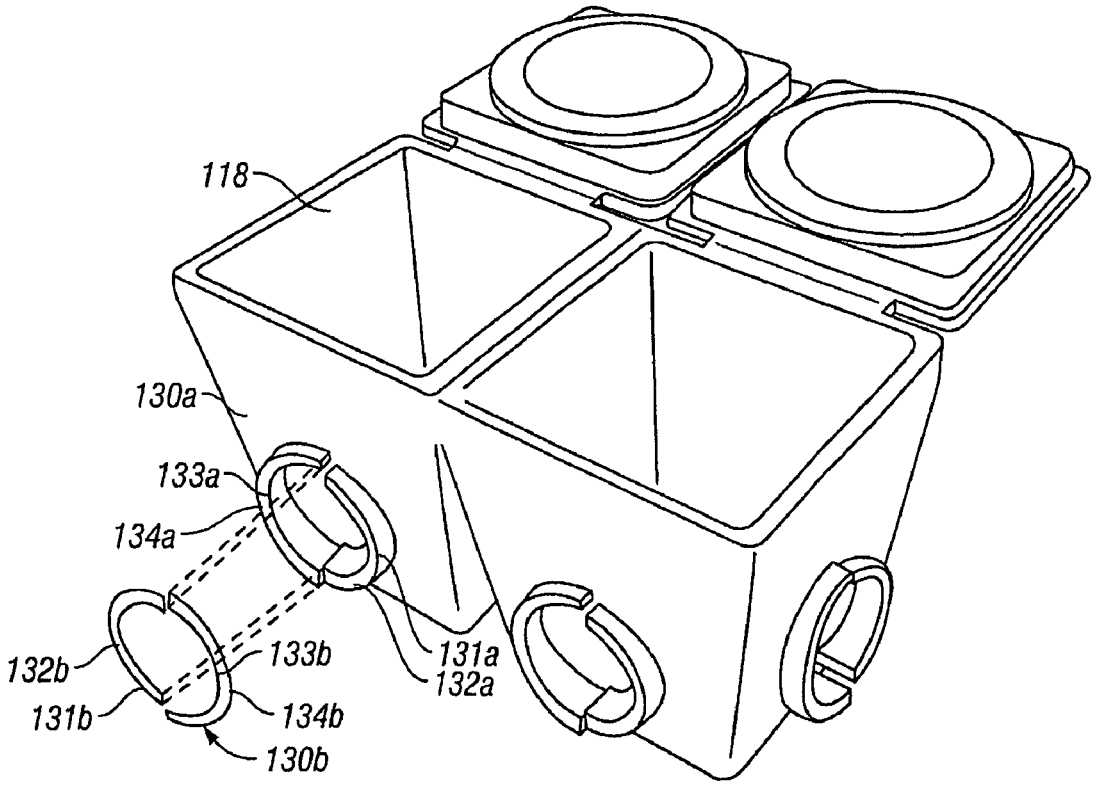
FIG. 7 shows a perspective view of a second modular assembly of two of the second food containers of FIGS. 6*a* and 6*b* together with a schematic detail of a mating connector arrangement.
Figure 8:
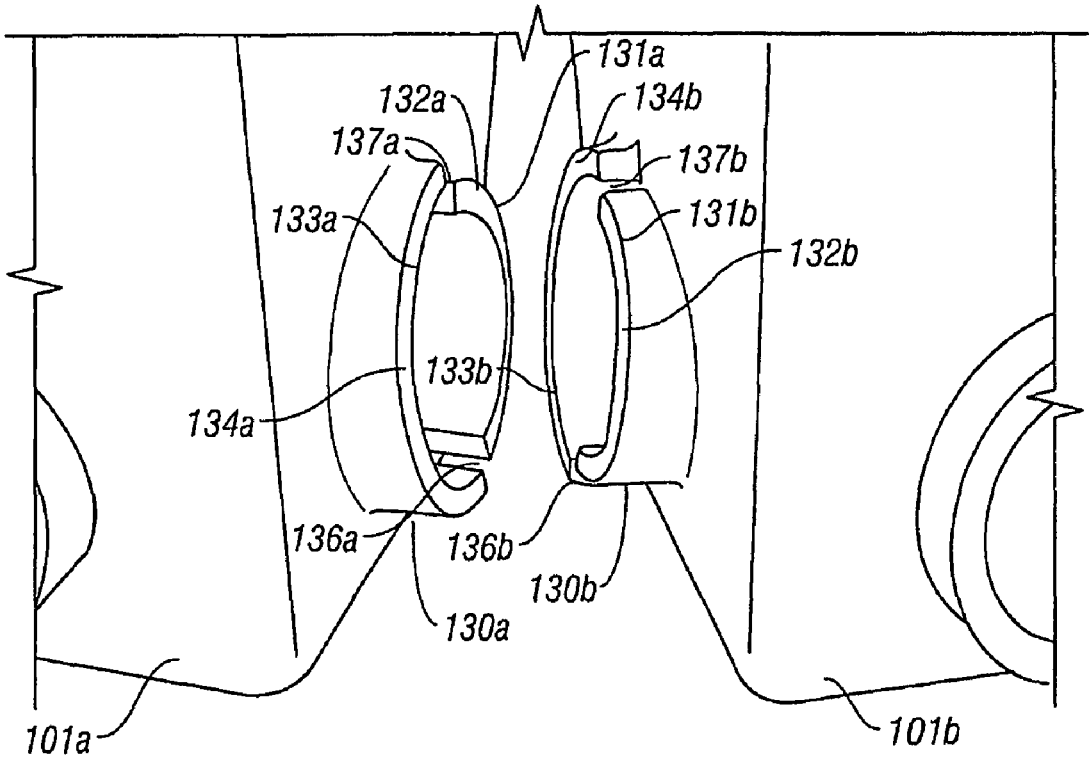
FIG. 8 shows a perspective view of a mating connector arrangement between two second food containers of FIGS. 6*a* and 6*b*.

More details of the 'half moon' mode of connection may be obtained by reference to FIG. 8, in which first and second containers 101*a*, 101*b* of the type shown in FIG. 1 are shown in near mating engagement, and also by reference to FIG. 7 in which alignment for mating is shown schematically.

Thus, a first dual half-moon connector 130*a* is mated with a second half-moon connector 130*b*, and that in the mating configuration the outer edge 131*a* of the first projecting half-circumferential wall 132*a* of the first half-moon connector seats 130*a* alongside/against the inner edge 133*b* of the second projecting half-circumferential wall 134*b* of the second half moon connector, and similarly the inner edge 133*a* of the second projecting half-circumferential wall 134*a* of the first half-moon connector 130*a* seats alongside/against the outer edge 131*b* of the first projecting half-circumferential wall 132*b* of the second half moon connector 130*b*. Gaps between the top 136*a*, 136*b* and bottom 137*a*, 137*b* of each 'half moon' pair 132*a*, 134*a* and 132*b*, 134*b* will be noted.

Figure 9:
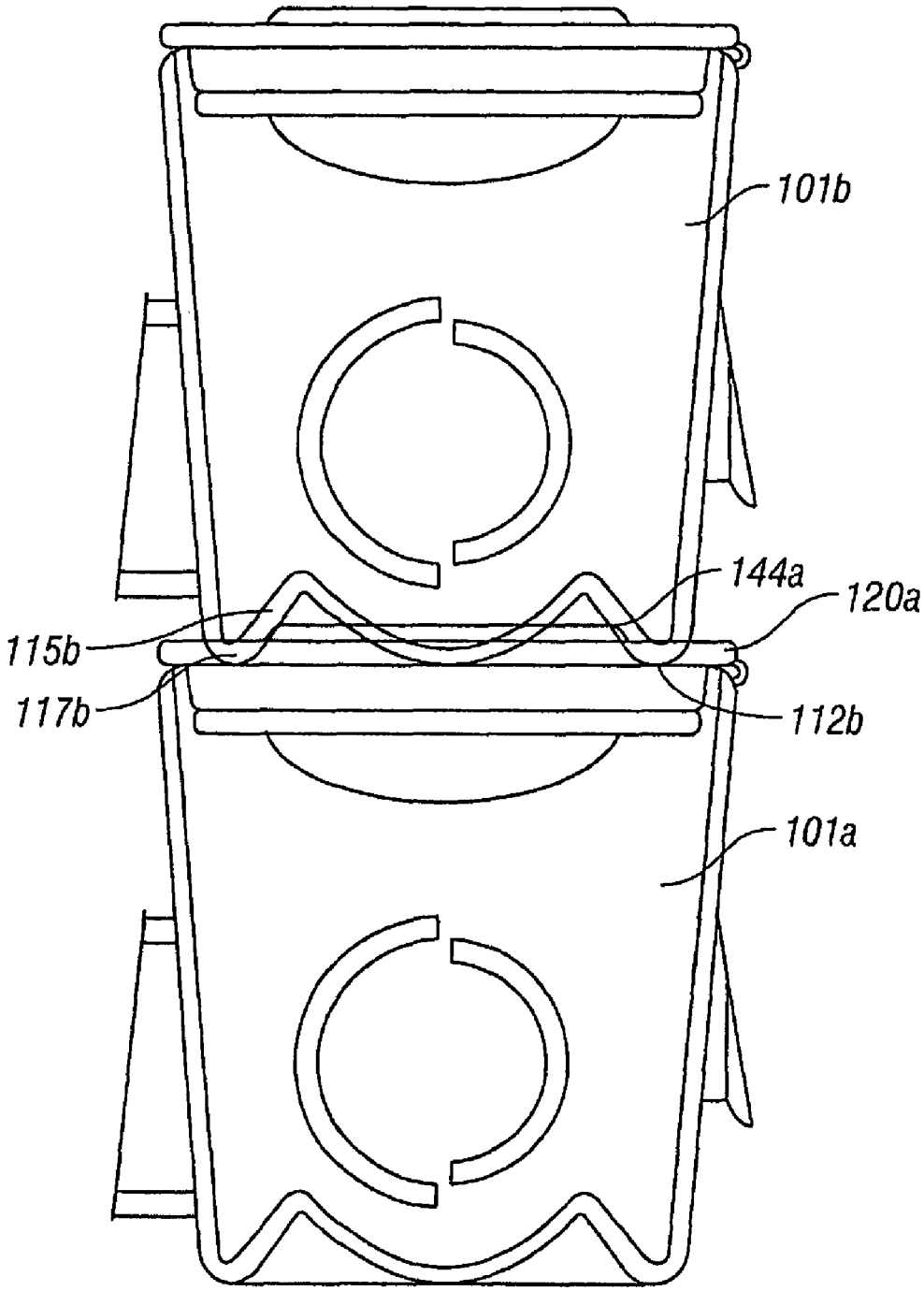
FIG. 9 shows a side view of a stacked arrangement between two second food containers of FIGS. 6*a* and 6*b*.

Details of a stacking arrangement of two of the second food containers 101*a*, 101*b* may be seen by reference to FIG. 9, in which for succinctness only relevant parts are labelled. The first securing portion 144*a* provided to the sealing lid 120*a* of a lower food container 101*a* has been snugly received within the periphery 117*b* of the tapering well-shaped insert 115*b* provided to the base 112*b* of an upper food container 101*b*. Thus, the first securing portion 144*a* of the lower food container 101*a* enable stacking of that container 101*a* to the well-shaped insert 115*b*, 117*b* of the base 112*b* of the second food container 101*b*. In embodiments, the interaction between the first securing portion 144*a* and well-shaped insert 115*b*, 117*b* is of a snap-fit or at least an engaging (e.g. squeeze-fit) nature.

It is an advantage of the food containers of the present invention that various modular assemblies thereof may be constructed using mating connections between individual food containers. Referring now to FIG. 7 a pair-wise form of assembly is illustrated, but it will be appreciated that other larger assemblies may also be constructed by additional mating arrangements.

Thus, FIG. 2 a pair-wise assembly 40 of two food containers 1*a*, 1*b* is shown. In FIGS. 3 and 4*a* rectangular form assembly 40 of eight food containers 1*a* to 1*h* is shown. It will be appreciated that other shapes of assembly may be constructed.

The application of which this description and claims form part may be used as a basis for priority in respect of any subsequent application. The claims of such subsequent application may be directed to any feature or combination of features described therein. They may take the form of product, method or use claims and may include, by way of example and without limitation, one or more of the following claims:

The invention claimed is:

1. A food container for use in containing a food portion for freezer storage thereof comprising a body defining a compartment for receipt of said food portion;

a sealing lid for reversible sealing of said compartment; and provided to said body, one or more connectors, each said connector arranged for reversible mating connection to a mating connector provided to the body of a second similar food container, wherein at least one of the one or more connectors comprises a first projecting half-circumferential wall; and a second projecting half-circumferential wall, wherein said first and second projecting half-circumferential walls extend radially about the same central point, but are radially displaced 180° relative to each other, and wherein the maximum radial extent of the first projecting half-circumferential wall is equal to or just less than the minimum radial extent of the second projecting half-circumferential wall, wherein the height of the first and second projecting half-circumferential walls varies from one end of the wall to the other, wherein the variation of height of the first wall mirrors that of the corresponding second wall.

2. The food container according to claim 1, wherein the first projecting half-circumferential wall has a first wall thickness and the second projecting half-circumferential wall has a second wall thickness and the first wall thickness is equal to the second wall thickness.

3. A food container according to claim 1, wherein the maximum radial extent of the first projecting half-circumferential wall is 0.1 to 2 mm less than the minimum radial extent of the second projecting half-circumferential wall.

4. The food container according to claim 1, wherein the body comprises a base, one or more walls, and a rim defining a mouth of said compartment.

5. The food container according to claim 4, wherein the base of the body is flexible such that a user may push up on the base to force frozen contents thereof from the compartment.

6. The food container according to claim 5, wherein the base is provided as a flexible insert to the body.

7. The food container according to claim 6, wherein said flexible insert is moulded to the body.

* * * * *